United States Patent [19]

Bruder

[11] Patent Number: 4,518,163

[45] Date of Patent: May 21, 1985

[54] EXERCISER WITH ELECTRICALLY CONTROLLED RESISTANCE

[75] Inventor: Frank J. Bruder, Newport Beach, Calif.

[73] Assignee: Arthur C. Bentley, Rossmore, Calif.

[21] Appl. No.: 423,560

[22] Filed: Sep. 27, 1982

Related U.S. Application Data

[63] Continuation of Ser. No. 198,795, Oct. 20, 1980, abandoned.

[51] Int. Cl.[3] ..... A63B 21/24

[52] U.S. Cl. ..... 272/132; 272/134

[58] Field of Search ..... 272/116, 128, 129, 130, 272/143, 144, DIG. 5, DIG. 6, 131, 132; 310/92, 93; 128/25 R; 73/379

[56] References Cited

U.S. PATENT DOCUMENTS

| | | | |
|---|---|---|---|
| 3,366,903 | 1/1968 | Searle et al. | 310/93 |
| 3,869,121 | 3/1975 | Flavell | 272/129 |
| 4,063,726 | 12/1977 | Wilson | 272/130 |
| 4,235,437 | 11/1980 | Ruis et al. | 272/129 |
| 4,261,562 | 4/1981 | Flavell | 272/129 |
| 4,354,676 | 10/1982 | Ariel | 272/129 |

FOREIGN PATENT DOCUMENTS

| | | |
|---|---|---|
| 230504 | 1/1911 | Fed. Rep. of Germany . |
| 2045215 | 2/1971 | France . |

*Primary Examiner*—Richard C. Pinkham
*Assistant Examiner*—Leo P. Picard
*Attorney, Agent, or Firm*—Knobbe, Martens, Olson & Bear

[57] ABSTRACT

An exercise apparatus equipped with an electrically controlled brake may be used for providing resistance force to movement of a holder bar by a user. A rotational transducer is provided to control the brake so that the magnitude of resistance force is varied with movements made by the user. A direction sensing and control circuit is provided to vary the amount of resistance force according to the direction of movement by the user.

6 Claims, 3 Drawing Figures

Fig. 1
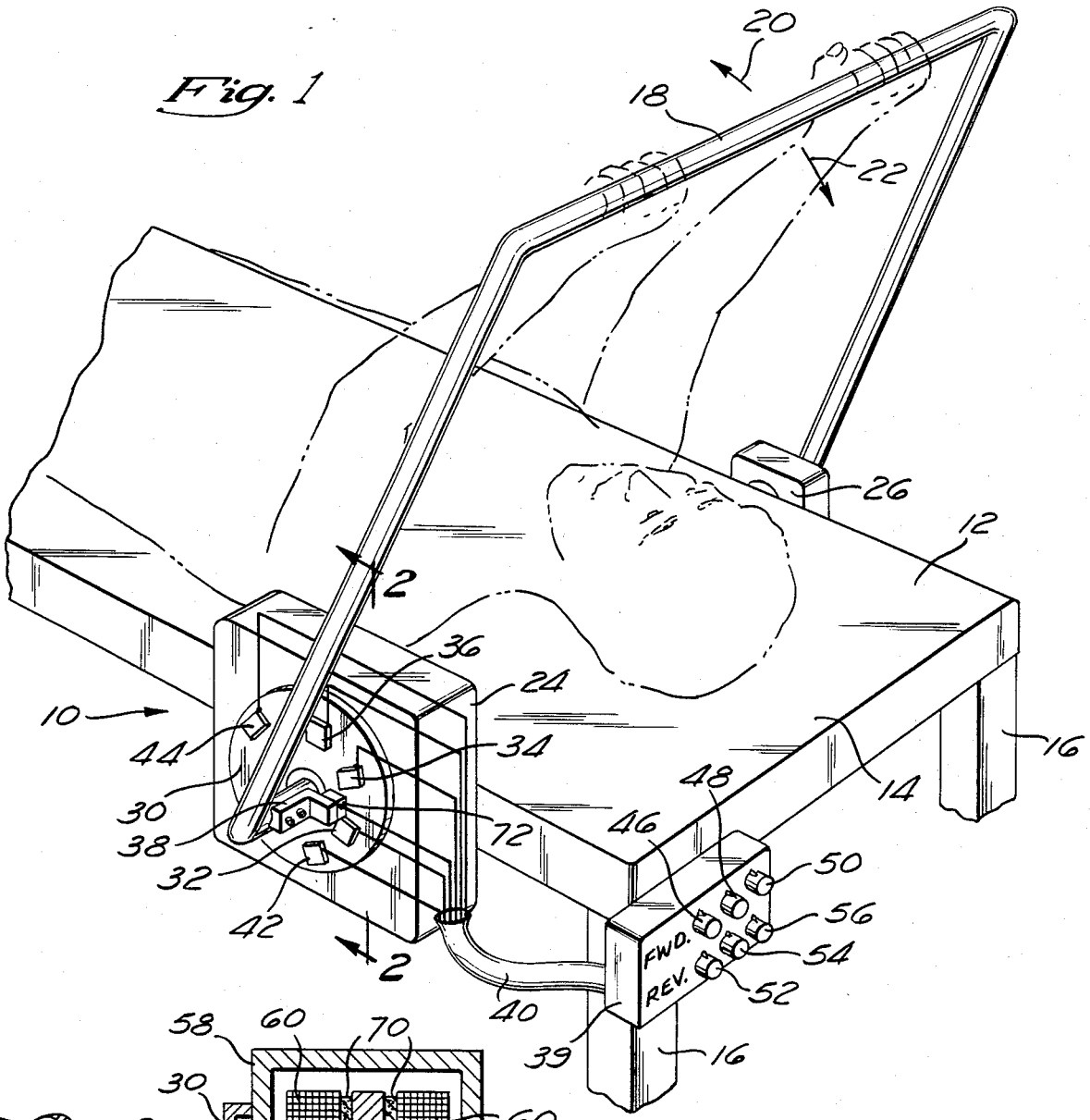
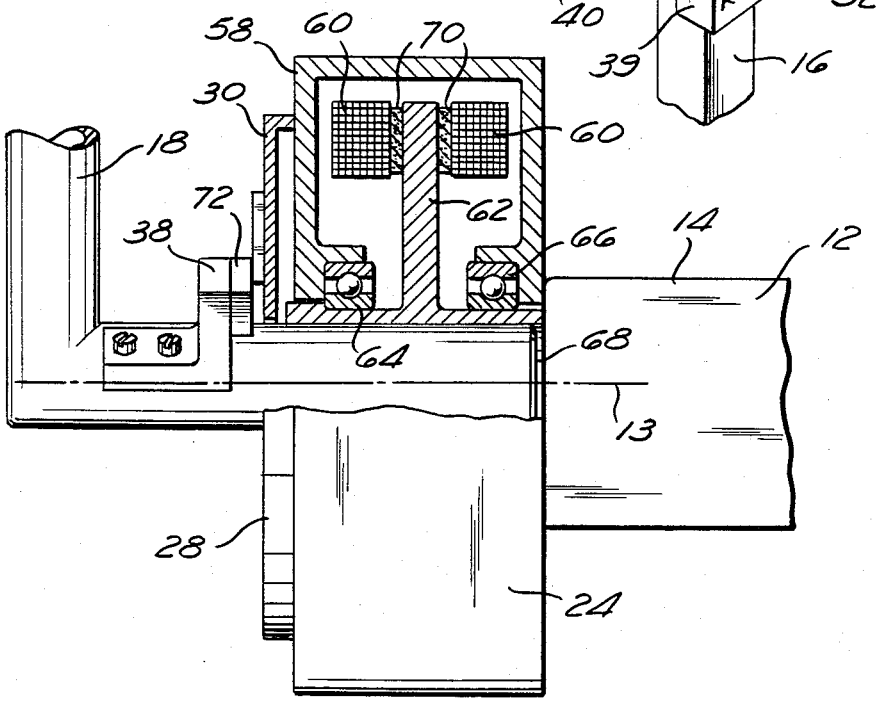
Fig. 2

EXERCISER WITH ELECTRICALLY CONTROLLED RESISTANCE

This application is a continuation of application Ser. No. 198,795, filed 10/20/80, now abandoned.

BACKGROUND OF THE INVENTION

This invention relates generally to exercise apparatus for use by human beings for physiological conditioning and pertains more particularly to movable structures which provide a resistance force which is electrically controllable.

One prior art weight training apparatus is disclosed by Bradley in U.S. Pat. No. 4,138,106. Bradley discloses the use of an electrical rewind motor to control the restraining effect on a cable reel which is connected, through cables, to a lifting bar.

Another type of prior art exercise apparatus is disclosed by Jungreis in U.S. Pat. No. 3,731,922, entitled "Method of Isotonic Exercise". Jungreis discloses the use of an electric motor to slideably move a weight along a beam in order to vary the force on the muscles of the user.

Various combinations of mechanical elements have been used in the past to construct exercise devices. Levers, weights, tables, and pulleys are among the elements which have been combined in various ways to produce exercise apparatus. A problem with the prior art is the unavailability of low cost, lightweight, portable, adjustable exercise apparatus for which the magnitude of resistance force may be precisely controlled across a range of movement.

SUMMARY OF THE INVENTION

Accordingly, it is an object of this invention to provide an exercise apparatus in the form of a therapy table for use in the physiological conditioning of human beings.

It is a further object of this invention to provide a therapy table exercise apparatus for providing a resistance force to movement by a user in which the magnitude of the resistance force is electrically controllable.

Another object of this invention is to provide an exercise apparatus which produces a resistance force which varies with the position of a manipulated bar and with the direction of movement of the bar.

A further object of this invention is to provide an exercise apparatus which is lightweight and of compact construction.

Briefly, this invention involves a holder bar rotatably mounted on a bench or table. The holder bar is designed to be grasped by the user and resistance to the rotation of the holder bar is provided by an electrically controlled brake. The braking force provided by the brake is adjusted by potentiometers which serve to control the magnitude of the braking force over separate regions in the range of movement of the holder bar. Switches and a relay are provided to sense the direction of movement of the holder bar and to vary the braking force in accordance with the direction of movement of the holder bar. A commutator switch is provided to detect the rotational position of the holder bar and to reverse the forces when the rotational direction is reversed.

DESCRIPTION OF THE DRAWINGS

These and other objects and advantages of my invention will appear more fully from the following description made in conjunction with the accompanying drawings, wherein like reference characters refer to the same or similar parts throughout the several views.

FIG. 1 is a partially cut-away side perspective view of the therapy table exercise apparatus;

FIG. 2 is a partially cut-away sectional view of the apparatus of FIG. 1 taken along the arrows 2—2.

DESCRIPTION OF THE PREFERRED EMBODIMENT

Figure 3:
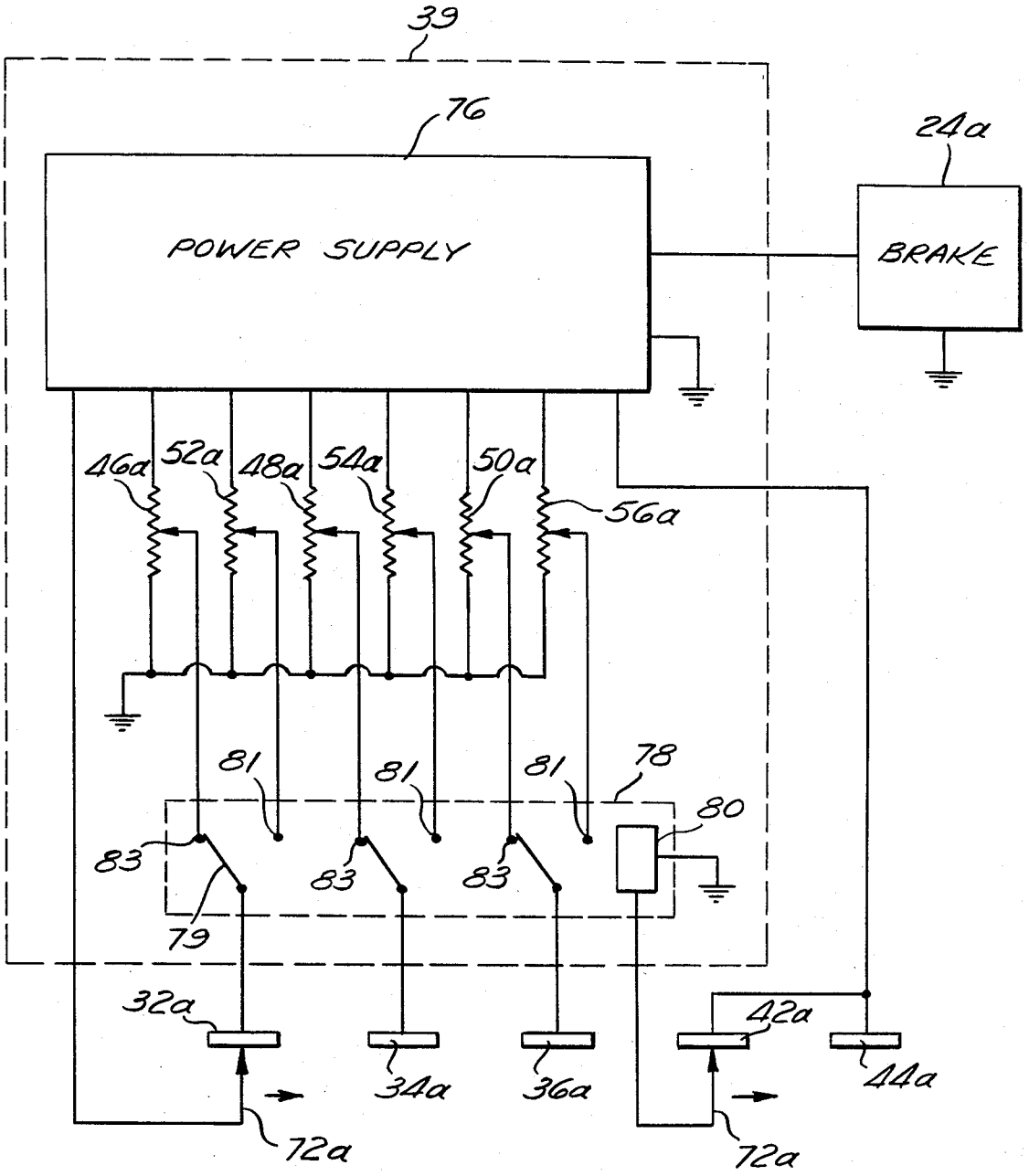
FIG. 3 is an electrical schematic diagram showing the brake and the electrical control circuitry used for controlling the brake in this invention.

FIG. 1 shows a therapy table exercise apparatus 10 including a bench 12 which consists of a horizontal slab 14 mounted on a plurality of vertical legs 16. The bench 12 is of sufficient size and construction to support a supine human being 11. A holder bar 18, formed as a rectangular C-shaped bar, is rotatably mounted about an axis 13 on the bench 12. The holder bar 18 may be rotated with respect to the bench 12 to move counterclockwise in the direction shown by an arrow 20, by the user 11, or to move clockwise in the direction shown by an arrow 22.

A combined pivot bearing and brake 24 is securely attached to one side of the bench 12 at the axis 13 and is axially aligned with a bearing 26, which is attached to the opposite side of the bench 12 along the axis 13. The holder bar 18 is rotatably mounted on the brake 24 and the bearing 26, so that the holder bar 18 is retained relative to bench 12 but is rotatable about the axis 13 with respect to the bench 12, with the brake 24 providing resistance force to clockwise and counterclockwise movement of the holder bar 18.

A rotational transducer 28 is mounted between the holder bar 18 and the bench 12 to sense the angular orientation of holder bar 18 with respect to bench 12. The rotational transducer 28 also serves to produce an electrical orientation signal indicative of the angular orientation of the holder bar 18 with respect to the bench 12 and also of the end limits of travel.

The rotational transducer 28 is an electrical commutator switch assembly consisting, in part, of a plate 30 having plural electrically conductive sector pads 32, 34, 36, 42 and 44 mounted along a circular path. The pads 32, 34, and 36 serve to define angular ranges in the rotation of the holder bar 18 with respect to the bench 12. The plate 30 is securely attached to the brake 24 so that the plate 30 is fixed in place relative to the bench 12.

The rotational transducer 28 also includes a wiper 38 rotatably mounted on plate 30 so that wiper 38 passes over, and makes electrical contact with, each of the sector pads 32, 34, 36, 42 and 44 as holder bar 18 is rotated with respect to bench 12. The wiper 38 is securely mechanically attached to the holder bar 18 and is electrically connected to a control box 39 by means of an electrical cable 40. The cable 40 includes a plurality of electrically conductive wires for interconnecting the wiper 38 and the sector pads 32, 34, 36, 42 and 44 with the control box 39.

The pair of sector pads 42 and 44 are securely mechanically attached to the plate 30 and thus fixed relative to the bench 12. As the holder bar 18 is rotated to the end of its motion in a forward direction, as shown by the arrow 20, the wiper 38 contacts the sector pad 44. Similarly, the sector pad 42 is contacted by wiper 38 when the holder bar 18 is rotated to the end of its motion in a reverse direction, as shown by the arrow 22. Taken together, sector pads 42 and 44 cooperate to define an operating angular range in the rotation of the holder bar 18 with respect to the bench 12.

Although the preferred embodiment of FIG. 1 discloses a rotational transducer 28 having five sector pads 32, 34, 36, 42 and 44, it should be understood that any number of sector pads greater than one would suffice to allow sensing of the angular orientation of the holder bar 18 with respect to the bench 12. The sector pads 32, 34, 36, 42 and 44 may be arranged in a circumferentially spaced-apart fashion as shown in FIG. 1 or may be radially staggered so that wiper 38 is allowed to simultaneously contact adjacent sector pads. The precision or resolution of the sensing of angular orientation between the holder bar 18 and the bench 12 would be increased by increasing the number of sector pads mounted on plate 30.

The control box 39 houses a power supply circuit which produces an electrical output signal, and a force programming circuit electrically connected to the power supply circuit. The force programming circuit controls the transfer of electrical power from the power supply circuit to the brake 24 to thereby control the braking force exerted by the brake 24 on the holder bar 18. Plural control knobs 46, 48, and 50 are mounted on the control box 39 and are adjustable to independently control the magnitude of the braking force provided by the brake 24 at each of the three angular orientations defined by pads 32, 34, and 36 when the holder bar 18 is moved in a forward direction 20. Similarly, plural control knobs 52, 54, and 56 are mounted on the control box 39 and are adjustable to control the braking force as holder bar 18 is rotated in a reverse direction 22.

Referring next to FIG. 2, the brake 24 includes a stator 58 attached to the bench 12 and having a stator coil 60 securely mounted therein. The stator coil 60 consists of a plurality of electrically conductive wire windings. The brake 24 is a commercially available electromechanical brake of the type manufactured by W. J. Industries, Inc., 10235 Bach Boulevard, St. Louis, Missouri 63132, U.S.A. The brake 24 also includes a rotor 62 and a pair of bearings 64 and 66 which support and align the rotor 62 in the stator 58. A shaft 68 extending from the holder bar 18 along the axis 13 is insertably mounted in and attached to the rotor 62. Thus, the bearings 64 and 66 rotatably support and align the holder bar 18 in stator 58 and further serve to retain the holder bar 18 relative to the bench 12.

Magnetic powder 70 is contained within the brake 24 between the coil 60 and the rotor 62. This magnetic powder 70 provides a bonding force between the coil 60 and the rotor 62, the magnitude of which is controlled by the magnitude of an electrical braking signal provided to the coil 60 from the control box 39. This magnetic powder 70 is a key element in the operation of the brake 24, in that the powder 70 functions as an electrically controllable, variable bond or link between the rotor 62 and the coil 60. The bonding force provided by the powder 70 is transferred through the coil 60, the stator 58, and the rotor 62 to produce a braking force that opposes rotation of the holder bar 18 relative to the table 12.

The electric braking signal provided by the control box 39 creates a current in the coil 60 which, in turn, creates a magnetic field (flux) which passes through the rotor 62, stator 58, and the magnetic powder 70. The magnetic field aligns the powder 70, forming links or bonds between the rotor 62 and the coil 60. The magnitude of bonding is approximately proportional to the magnitude of current in coil 60.

A wiper pad 72 is electrically conductive and is a portion of the wiper 38. Wiper pad 72 passes over, and makes electrical contact with, each of the sector pads 32, 34 and 36, in turn, as the holder bar 18 is rotated with respect to the bench 12. The wiper pad 72 is electrically connected with the control box 39.

Referring next to FIG. 3, the control box 39 includes a power supply 76, a commercially available unit which serves to convert AC line power to a regulated DC voltage The DC control voltages of the power supply 76 are electrically connected to a double throw relay 78 of the usual, commercially available type. The relay 78 includes one pole for each of the number of sector pads mounted on the plate 30. As will be understood from the following description, the relay 78, in conjunction with the sector pads 42 and 44, provides a latching relay function. The unlatched state of the relay 78 corresponds to operation of the exercise apparatus 10 when the holder bar 18 is moving in a forward direction, as shown by arrow 20 (FIG. 1). The latched state of relay 78 corresponds to the operation of exercise apparatus 10 when the holder bar 18 is moving in a reverse direction, as shown by arrow 22 (FIG. 1).

The electrical contacts **42*a* and 44*a* are the electrical schematic representation of the sector pads 42 and 44, respectively, shown in FIG. 1. The electrical contact 44*a* is normally open and momentarily closes to energize the coil 80, and thus close the relay contactor 79 to latch the relay 78, when the holder bar 18 contacts the electrical contact 44. The electrical contact 42*a* is normally open and is connected in parallel with the electrical contact 44*a* to provide current to the coil 80, and thus latch the relay 78, once the switch 44*a* has been momentarily closed. After assuming a latched state, the relay 78 assumes an unlatched state when the wiper 38 contacts the sector pad 42. Thus, the relay 78 provides a "memory" to indicate the direction that the holder bar 18** is being moved.

Plural variable resistors **52*a*, 54*a*, and 56*a* correspond to the control knobs 52, 54, and 56, respectively, of FIG. 1. The wipers of these variable resistors 52*a*, 54*a*, and 56*a* are connected to a first terminal 81 of the relay 78 to energize the power supply 76 only when the relay 78 is in its unlatched state. Thus, the variable resistors 52*a*, 54*a*, and 56*a* serve to control the magnitude of current provided to the brake 24*a* when the holder bar 18 is moving in a reverse direction, as shown by arrow 22 (FIG. 1). The brake 24*a* is an electrical schematic representation corresponding to the brake 24 of FIG. 1**.

An additional group of variable resistors **46*a*, 48*a*, and 50*a* correspond to control knobs 46, 48, and 50 of FIG. 1. The wipers of these resistors 46*a*, 48*a*, and 50*a* are connected to a second terminal 83 of the relay 78 to energize the power supply 76 only when the relay 78 is in its latched state. The variable resistors 46*a*, 48*a*, and 50*a* serve to control the magnitude of current provided to the brake 24*a* when the holder bar 18 is moved in a forward direction, as shown by arrow 20 (FIG. 1**).

The variable resistors **46*a*–56*a* may each be independently adjusted to control the magnitude of current provided to the brake 24*a* as the wiper 38 (FIG. 2) moves across sector pads 32, 34, and 36, respectively. Electrical contacts 32*a*, 34*a*, and 36*a* are schematic representations of the sector pads 32, 34, and 36** (FIG.

1), respectively, while a switch arm 72*a* is an electrical schematic representation of the wiper 38. The function of switch arm 72*a* is to make selective electrical contact with one of the electrical contacts 32*a*, 34*a*, or 36*a* as the holder bar 18 is moved through sequential rotational segments. When the switch arm 72*a* connects with the contact 32*a*, power for the brake 24*a* is controlled by the variable resistor 46*a* or 52*a*, depending upon the state of relay 78. Similarly, when the switch arm 72*a* connects with contact 34*a*, the current in the brake 24*a* is controlled by the variable resistor 48*a* or 54*a*, depending upon the state of relay 78. Also, when switch arm 72*a* connects with contact 36*a*, the variable resistor 50*a* or 56*a* controls the current provided to brake 24*a*, depending upon the state of relay 78.

The elements disclosed in FIG. 3, absent the brake 24*a*, form an electrical control circuit to supply an electric braking signal to the brake 24*a*, and to thereby control the braking force provided by the brake 24. The arm 72*a*, when combined with the contacts 32*a*, 34*a*, and 36*a*, corresponds to a rotational transducer which produces an electrical orientation signal indicative of the angular orientation of the holder bar 18 with respect to the bench 12. Taken together, the variable resistors 46*a*–56*a* form a force programming circuitry to control the transfer of electrical power from the power supply 76 to the brake 24*a* and to thereby control the braking force provided by the brake 24. Taken together, the relay 78, the electrical contact 42*a*, and the electrical contact 44*a* form a direction sensing and control circuit to sense the direction of rotation of the holder bar 18 with respect to the bench 12 and to control the force programming circuitry to independently select the magnitude of braking force for each direction of rotation of the holder bar 18.

The electrical resistance of each of the variable resistors 46*a*–56*a* are independently adjustable to control the transfer of electrical power to the brake 24*a*. These variable resistors 46*a*–56*a* cooperate with the sector pads 32, 34, and 36 to define independently adjustable resistance force ranges corresponding to angular ranges in the rotation of the holder bar 18.

Thus, when holder bar 18 is rotated so that the wiper 38 contacts the sector pad 32, and the holder bar 18 is moving in a forward direction so that the relay 78 is in an unlatched state, the magnitude of braking provided by the brake 24 is controlled by the setting of variable resistor 46*a*. Under the same conditions, as bar 18 is rotated so that the wiper 38 moves onto pad 34, the setting of the variable resistor 48*a* controls the braking force provided by the brake 24. Then, under the same conditions, as the wiper 38 moves onto the pad 36, the magnitude of braking force is controlled by the setting of the variable resistor 50*a*. When the holder bar 18 moves fully forward to touch limit switch 44, thus causing the relay 78 to latch, the variable resistor 56*a* will control the magnitude of current provided to brake 24*a* as holder bar 18 is moved in a reverse direction, as shown by the arrow 22. As the holder bar 18 is pulled further backwards, the wiper 38 moves into contact with the pad 34 so that the variable resistor 54*a* controls the magnitude of braking force. Under the same conditions, as the holder bar 18 is rotated so that the wiper 38 contacts the sector pad 32, the variable resistor 52*a* controls the magnitude of braking force provided by the brake 24. Finally, the holder bar 18 is moved fully back in a reverse direction, the holder bar 18 contacts the sector pad 42 which causes the relay 78 to unlatch, thus allowing the cycle to be repeated.

The sector pads 32–36 are formed to cover rotational segments of the bar 18 in accordance with physical therapy requirements, and may thus extend through unequal angular ranges.

In operation, a person using this exercise apparatus 10 may lie down in a horizontal position on the slab 14. The user's upper torso is preferably placed across the axis 13 so that the user's arms may conveniently be extended to allow the user to grasp the holder bar 18. The holder bar 18 is then rotated by the user who may exert pushing and pulling forces using his or her arm, shoulder, and back muscles. The rotational transducer 28 defines a plurality of angular ranges in the rotation of the holder bar 18 so that braking forces applied to the bar 18 may be adjusted according to the angular orientation of the bar 18. As the bar 18 is rotated, various different groups of the user's muscles come into play and the groups of muscles vary in their relative strength. Thus, the rotational transducer 28 allows the exercise apparatus 10 to be adjusted so that each of the groups of the user's muscles is stressed to the desired degree. This adjustment is performed by varying the settings of the knobs 46–56.

When in such a horizontal, supine position, the user imitates a rowing motion with his hands to cause the holder bar 18 to oscillate between the sector pad 42 and the sector pad 44. The relay 78 is provided to allow a different level of stress to be applied to muscles which are used to push the bar 18 in the direction 20 than the stress which is provided to muscles which are used to pull the bar 18 in the direction 22.

The exercise apparatus 10 may be modified by changing the shape of holder bar 18 to allow a user to sit upon the slab 14 and to move the bar 18 with the user's feet and legs. A further possible variation for the exercise apparatus 10 is to change the shape of holder bar 18 so that a user may stand vertically adjacent the bench 14 and move the bar 18 up and down with the aid of the user's hands and arms.

It is a anticipated that various changes may be made in the shape, construction, and operation of the invention as disclosed herein without departing from the spirit and scope of the invention as defined by the following claims.

What is claimed is:

1. An exercise apparatus comprising:

a bench;

a holder bar rotatably mounted on said bench, and positioned for manipulation by the body of an operator;

a brake mechanically connected between said bench and said holder bar for providing resistance force to movement of said holder bar, said resistance force being electrically controllable in response to a braking signal;

an electrical control electrically connected to supply said braking signal to said brake, and to thereby control the braking force provided by said brake, wherein said electrical control comprises:

a power supply providing an electrical power output signal;

a rotational transducer mounted between said holder bar and said bench for sensing the angular orientation of said holder bar with respect to said bench, and for producing an electrical orientation signal indicative of said angular orientation;

force programming means electrically connected to said power supply, said rotational transducer means, and said brake, for controlling the transfer of said electrical power output signal to said brake to control said braking force, said force programming means being adjustable to independently control the magnitude of said braking force at each of a plurality of said angular orientations;

a first electrical contact mounted on said bench and positioned to be activated as said holder bar is rotated in a first direction;

a second electrical contact mounted on said bench and positioned to be activated as said holder bar is rotated in a second direction, said first and second electrical contacts defining an operating angle range in the rotation of said holder bar with respect to said bench; and a relay electrically connected to said first electrical contact, said second electrical contact, said brake, and said plurality of resistors, for providing a first direction state in response to said first electrical contact, and a second direction state in response to said second electrical contact, and for electrically connecting a first set of said resistors to said brake in said first direction state, and electrically connecting a second set of said resistors to said brake in said second direction state;

wherein said rotational transducer comprises an electrical commutator switch assembly comprising:

a plate having a plurality of electrically conductive sector pads mounted along a circular path thereon, said sector pads defining angular ranges in the rotation of said holder bar with respect to said bench; and a wiper rotatably mounted on said plate and having an electrically conductive wiper pad, said wiper pad making electrical sequential contact with each of said sector pads as said holder bar is rotated with respect to said bench.

2. The exercise apparatus of claim 1 wherein said force programming means comprises:

a plurality of resistors connected to said brake and to separate ones of said sector pads, the electrical resistance of each resistor being adjustable to independently control the transfer of said electrical power output signal to said brake, said resistors cooperating with said sector pads to define independently adjustable resistance force ranges corresponding to said angular ranges.

3. An exercise apparatus comprising:

a base;

a member, mounted on said base, and movable in forward and reverse directions through a plurality of ranges of movement relative to said base, said member positioned to be moved by an operator in said forward and reverse directions for exercising;

a magnetic brake mounted on said base for providing resistance force to relative movement of said member and said base, the resistance being approximately proportional to the magnitude of the electrical current supplied to the magnetic brake; and an electrical control device for varying the magnitude of the current supplied to the magnetic brake to control said brake, wherein said electrical control device comprises:

a detector for detecting the range and direction of movement of said member with respect to said base including a transducer mounted between said member and said base for sensing the range of movement of said member with respect to said base, and for producing an electrical orientation signal indicative of said range of movement wherein said detector comprises:

an electrical commutator switch assembly comprising a plate having a plurality of electrically conductive sector pads mounted along a path thereon, said sector pads defining ranges in the movement of said member with respect to said base; and a wiper mounted on said member and having electrically sequential contact with each of said sector pads as said member is moved with respect to said base; and a controller for independently controlling the magnitude of the current supplied to said magnetic brake in each of said ranges for each direction of movement of said member with respect to said base to independently vary the resistance force in each range of movement for each direction of movement, said controller including a power supply for providing an electrical power output signal and a force programmer electrically connected to said power supply, to said detector, and to said brake, for controlling the transfer of said electrical power output signal to said brake to control the resistance force, said force programmer being adjustable to independently control the magnitude of said braking force at each of a plurality of said angular orientations.

4. An exercise apparatus as defined in claim 3, wherein said force programmer comprises a plurality of resistors connected to said brake and to separate ones of said sector pads, the electrical resistance of each of said resistors being adjustable to independently control the transfer of said electrical power output signal to said brake, said resistors cooperating in use with said sector pads to define independently adjustable resistance force ranges corresponding to said angular ranges of movement.

5. An exercise apparatus as defined in claim 4, wherein said electrical control device further comprises:

a first electrical contact mounted on said base and positioned to be activated as said member is moved in a first direction;

a second electrical contact mounted on said base and positioned to be activated as said member is moved in a second direction, said first and second electrical contacts defining an operating range in the movement of said member with respect to said base; and relay means electrically connected to said first electrical contact, said second electrical contact, said brake, and said plurality of resistors, for providing a first direction state in response to said first electrical contact, and a second direction state in response to said second electrical contact, and for electrically connecting a first set of said resistors to said brake in said first direction state, and electrically connecting a second set of said resistors to said brake in said second direction state.

6. An exercise apparatus, comprising:

a base comprising a bench to support a human being;

a holder bar rotatably mounted on said base so as to be rotated by said human being, wherein said bar can be rotated in a first direction and in a second, opposite direction through a plurality of ranges of angular orientation in each direction;

a magnetic brake mounted on said base and coupled to said bar for providing a resistance to rotational movement of said bar relative to said base, wherein said brake comprises:

a stator attached to said base and having a stator coil securely mounted therein;

a rotor attached to said bar and rotatably mounted within said stator coil; and magnetic powder positioned between said stator coil and said rotor, said magnetic powder providing a bonding force between said stator coil and said rotor, wherein the magnitude of said bonding force is substantially proportional to the magnitude of a current supplied to said coil, wherein said bonding force between said stator coil and said rotor produces said resistance to rotational movement of said bar relative to said base;

an electrical wiper coupled to said bar so as to move through an arcuate path as said bar is rotated;

a plurality of electrical contacts mounted on said base in an arcuate arrangement, wherein said contacts are positioned to be contacted by said wiper as said wiper moves through its arcuate path, and wherein each of said contacts corresponds to one of said ranges of angular orientation of said bar;

two sets of electrical resistors, wherein each set comprises a plurality of electrical resistors having variable resistance, each resistor of each set is selectively connected to one of said contacts, and the resistance of each of said variable resistors is independently adjustable;

an electrical power supply coupled to each of said variable resistors and to said coil of said magnetic brake so the amount of current supplied to said coil is controlled by said variable resistors;

a first end electrical contact mounted on said base so as to be contacted by said wiper when said wiper is at one end of its arcuate path, and a second end electrical contact mounted on said base so as to be contacted by said wiper when said wiper is at the other end of its arcuate path, wherein when said wiper contacts said first end electrical contact, the resistors of one of said sets of resistors are connected to said contacts, and when the wiper contacts said second end electrical contact the resistors of the other set of resistors are connected to said contacts so that when said bar is rotated in one direction to move said wiper from said first end contact to said second end contact, one of said sets of resistors is connected to said contacts, and as said bar is rotated in the opposite direction to move said wiper from said second end contact to said first end contact the other of said sets of resistors is connected to said contacts; and a power supply connected to said coil of said magnetic brake, to said wiper, and to said variable resistors so that when said wiper contacts one of said electrical contacts, a circuit is formed to supply a current to said coil, wherein the magnitude of the current supplied to said coil is controlled by the variable resistance of the one of said variable resistors connected to said contacted electrical contacts.

* * * * *